United States Patent [19]

Sakaguchi et al.

[11] Patent Number: 5,049,465

[45] Date of Patent: Sep. 17, 1991

[54] ELECTROPHOTOGRAPHIC PHOTOSENSITIVE MATERIAL AND METHOD OF PREPARING SAME

[75] Inventors: Junei Sakaguchi, Tokyo; Soichi Hasegawa, Misato; Shuichi Arai, Saitama, all of Japan

[73] Assignee: Somar Corporation, Japan

[21] Appl. No.: 434,262

[22] Filed: Nov. 13, 1989

[30] Foreign Application Priority Data

| | | | |
|---|---|---|---|
| Nov. 15, 1988 | [JP] | Japan | 63-289624 |
| Feb. 1, 1989 | [JP] | Japan | 1-23249 |
| Feb. 28, 1989 | [JP] | Japan | 1-47571 |
| Apr. 19, 1989 | [JP] | Japan | 1-99196 |

[51] Int. Cl.[5] ..... G03G 5/06

[52] U.S. Cl. ..... 430/59; 430/78; 430/132

[58] Field of Search ..... 430/58, 72, 76, 59, 430/78, 132

[56] References Cited

U.S. PATENT DOCUMENTS

| | | | |
|---|---|---|---|
| 4,642,280 | 2/1987 | Ueda | 430/83 |
| 4,657,834 | 4/1987 | Tachiki et al. | 430/58 |
| 4,814,245 | 3/1989 | Horie et al. | 430/59 |
| 4,839,252 | 6/1989 | Murata et al. | 430/59 |
| 4,865,934 | 9/1989 | Uewda et al. | 430/59 |
| 4,882,427 | 11/1989 | Enokida et al. | 430/72 |
| 4,889,785 | 12/1989 | Kobata et al. | 430/59 |

FOREIGN PATENT DOCUMENTS

| | | |
|---|---|---|
| 0180931 | 10/1985 | European Pat. Off. . |
| 3813459A1 | 4/1987 | Fed. Rep. of Germany . |

OTHER PUBLICATIONS

Patent Abstracts of Japan, vol. 10, No. 154, (P-463), 6/4/86.

*Primary Examiner*—John Goodrow
*Attorney, Agent, or Firm*—Lorusso & Loud

[57] ABSTRACT

An electrophotographic photosensitive material suitable for application to a lazer beam printer is disclosed which includes an electrically conductive support having provided thereon a charge generating layer containing a titanium phthalocyanine pigment and a charge transporting layer containing a specific hydrazone compound. The charge transporting layer may be prepared by coating with a solution containing the specific compound, a polycarbonate resin and a dioxane-containing solvent.

8 Claims, 1 Drawing Sheet

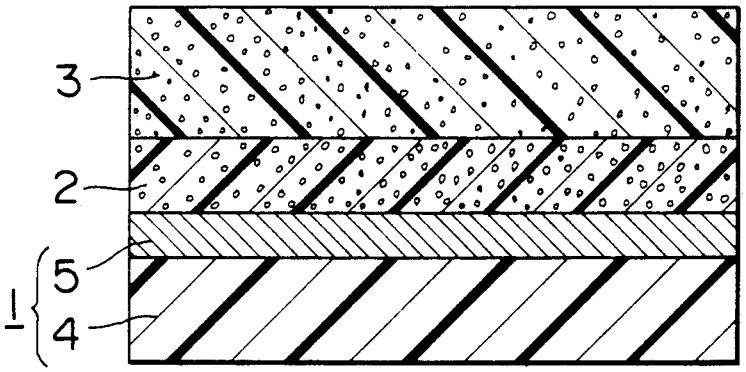
3
2
5
1
4

ELECTROPHOTOGRAPHIC PHOTOSENSITIVE MATERIAL AND METHOD OF PREPARING SAME

This invention relates generally to an electrophotographic photosensitive material and to a method of preparing same. More particularly, the present invention is directed to an electrophotographic photosensitive material useful for application to a laser beam printer.

Because of their high image resolution and high printing speed, semiconductor laser beam printers have been widely developed and are now on the market. Since a diode laser has an oscillation wavelength in a near infrared region ($\lambda > 780$ nm), a photosensitive material to be used in such printers is required to have a high sensitivity in a wavelength region of 780–830 nm.

Certain inorganic photosensitive compounds such as selenium-tellurium compounds, selenium-arsenic compounds, amorphous silicon and sensitized cadmium sulfide are known to have a relatively high sensitivity. However, these compounds pose a problem because they are toxic and difficult to be formed into a film.

Photosensitive materials containing an organic photosensitive compound such as polyvinylcarbazole sensitized with 2,4,7-trinitrofluorenone are also known. The known, organic-type photosensitive materials are not completely suitable for application to laser beam printers because of their poor sensitivity in the 780–830 wavelength region.

There is known a multi-active electrophotographic photosensitive material having at least two layers comprising charge generating layer and a charge transporting layer formed on an electrically conductive support (U.S. Pat. No. 4,175,960). In this composite layered photosensitive material having two layers with different functions, which has been developed for improving sensitivity and service life thereof, the sensitivity thereof depends on the carrier generation efficiency in the charge generating layer, carrier injection efficiency at the boundary of the charge generating and charge transporting layers, and carrier transporting efficiency in the charge transporting layer. Thus, it is important to select a combination of photosensitive compounds for the two layers which is suited for providing optimum charge generating, injecting and transporting efficiencies. While a number of combinations photosensitive compounds for such composite layered photosensitive materials have been hitherto proposed, they are not quite satisfactory.

The present invention has been made to overcome the problems of conventional photosensitive materials. In accordance with the present invention there is provided an electrophotographic photosensitive material comprising a charge generating layer and a charge transporting layer formed on an electrically conducting support, said charge generating layer containing a titanium phthalocyanine pigment and said charge transporting layer containing a compound expressed by the following general formula (I):

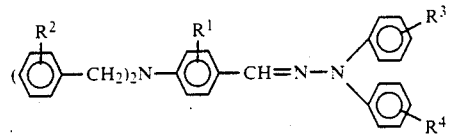

(I)

wherein $R^1$, $R^2$, $R^3$ and $R^4$ stand, independently from each other, for hydrogen or a lower alkyl.

In another aspect, the present invention provides a method of preparing the above photosensitive material, comprising the steps of:

(a) providing a solution containing a polycarbonate resin, said compound of the formula (I) and a dioxane-containing solvent;

(b) forming said charge generating layer on said support;

(c) applying said solution over said charge generating layer to form a coated layer; and (d) drying said coated layer to form said charge transporting layer on said charge generating layer.

The present invention will now be described in detail below with reference to the accompanying drawing, in which the sole FIGURE is a cross-sectional view diagrammatically illustrating a photosensitive material according the present invention.

Referring to the FIGURE, designated generally as 1 is an electrically conductive support having provided thereon a charge generating layer 2 and a charge transporting layer 3. The support 1 in this embodiment consists of an insulating substrate 4 coated with an electrically conductive layer 5.

The insulating substrate 4 may be formed of a plastic material such as a polyester resin, a phenol resin or a polyolefin resin. The conductive layer may be formed, for example, of aluminum, nickel, chromium, zinc, stainless steel, tin oxide or carbon. The formation of the conductive layer 5 on the substrate 4 may be effected by, for example, vacuum evaporation, ion spattering or coating. As the electrically conductive support 1, there may be used an electrically conducting substrate or plate formed of, for example, aluminum or copper.

The charge generating layer 2 contains a titanium phthalocyanine pigment. By the term "titanium phthalocyanine pigment" is meant phthalocyanine whose two hydrogen atoms bonded to the nitrogen atoms are substituted by titanium and which may be substituted with halogen or a sulfonyl group. The charge generating layer 2 has generally a thickness of 0.01–2.0 μm, preferably 0.1–0.5 μm.

The charge transporting layer 3 contains the compound expressed by the above general formula (I). The thickness of the layer 3 is generally 12–20 μm, preferably 16–20 μm.

In the present specification and appended claims, the term "lower alkyl" denotes a linear or branched saturated monovalent aliphatic hydrocarbon group and includes, for example, methyl, ethyl, n- or iso-propyl, n-, iso-, sec- or tert-butyl, n-pentyl, iso-amyl, n-hexyl and n-octyl.

The photosensitive material having the above construction using the specific combination of photosensitive compounds exhibits excellent charging characteristics and is extremely low in residual electric potential. In addition, the photosensitive material is low in both half-life during light exposure and dark decay and has a high sensitivity in a wavelength region of 780–830 nm.

It is preferred that the charge generating layer further contain a substituted naphthalene for reasons of improving dark decay characteristics. That is, the incorporation of the substituted naphthalene into the charge generating layer can reduce dark decay without adversely affecting the sensitivity.

The term "substituted naphthalene" means naphthalene substituted with one or more substituents such as halogen atoms, e.g. chlorine and bromine, lower alkyl groups, e.g. methyl and ethyl, and lower alkoxy groups, e.g. methoxy and ethoxy. Examples of suitable substituted naphthalenes include chloronaphthalenes, methylnaphthalenes and methoxynaphthalenes.

The substituted naphthalene is preferably used in an amount 25–200%, more preferably 40–200% based on the weight of the charge generating layer.

The photosensitive material according to the present invention may be prepared by the following method.

The charge generating layer may be formed by providing a dispersion containing the titanium phthalocyanine pigment, a binder and a solvent, coating the dispersion and drying the coat. As the binder, there may be used any known binder used in the field of photosensitive material, such as a polyester, a polyvinylbutylal, a polymethylmethacrylate, a phenoxy resin, a polyamide or a phenol resin. Illustrative of suitable binder are a polyester having a molecular weight of 15,000–20,000 and obtained by reaction of terephthalic acid or isophthalic acid with ethylene glycol and a polyvinyl butylal having a molecular weight of 10,000–100,000. The amount of the binder is generally 0.6–2.0, preferably 0.8–1.4 times the weight of the titanium phthalocyanine pigment. Preferably, the titanium phthalocyanine pigment is ground into fine powder having a particle size of 0.5 μm or less by means of a ball-mill, a sand-mill, an ultrasonic homogenizer or the like grinding device. The coating of the dispersion may be carried out by any known method using, for example, a wire bar, a doctor blade or an applicator.

It is preferable to use a dioxane/cyclohexanone mixed solvent as a solvent for the formation of the above dispersion for reasons of providing a tightly bonded, homogeneous charge generating layer and of freeness of so-called "brushing" phenomenon of the charge generating layer which causes lowering of sensitivity. Good results are obtainable when the mixed solvent is composed of 3–100 parts by weight of cyclohexanone and 100 parts by weight of the dioxane, especially 5–50 parts by weight of cyclohexanone and 100 parts by weight of dioxane.

The charge transporting layer may be formed by providing a solution containing the compound of the formula (I), a binder and a solvent, coating the solution and drying the coat. As the binder, there may be used any known binder used in the field of photosensitive material, such as a polycarbonate, an acrylic resin, a methacrylic resin, polyurethane or a polyester. It is preferable to use as the binder a polycarbonate resin, especially one obtained by reaction of Bisphenol A with phosgene in a solvent in the presence of a base and having a molecular weight of 24,000–30,000. The amount of the binder is generally 0.6–1.5, preferably 0.8–1.2 times the weight of the compound of the formula (I).

When a polycarbonate is used as the binder, it is preferable to use a dioxane-containing solvent. The dioxane-containing solvent is preferably used in an amount of 3–10 times, more preferably 5–10 times, most preferably 6–9 times the weight of the polycarbonate resin and may contain 0–100 parts by weight, preferably 0–70 parts by weight, more preferably 10–50 parts by weight, per 100 parts by weight of the dioxane, of an auxiliary solvent such as tetrahydrofuran, dichloroethane and cyclohexanone. The polycarbonate has been found to form a gel or an aggregate when tetrahydrofuran is used as a solvent for the preparation of a coating solution. On the other hand, by using dioxane or a mixed solvent containing dioxane is used, the occurrence of such gellation or aggregation of the polycarbonate has been found to be avoided.

A variety of modifications can be made to the foregoing embodiments without departing from the spirit of the present invention. For example, while the embodiment shown in the FIGURE has only two, charge generating and charge transporting layers 2 and 3 on the support 1, the photosensitive material can be further provided with one or more layers, such as a top, surface protecting layer, a primer layer over the electrically conductive support and/or an intermediate layer between the charge generating and transporting layers. Further, the charge generating layer may be provided over the charge transporting layer.

The following examples will further illustrate the present invention. In the examples, "part" is "by weight".

EXAMPLE 1

| Coating Liquid for Charge Generating Layer: | |
|---|---|
| Saturated polyester resin*[1] | 1.5 parts |
| Titanium phthalocyanine | 1.5 parts |
| Tetrahydrofuran | 85 parts |

*[1]Bilon 200 (manufactured by Toyo Boseki K.K.)

The above polyester resin was dissolved in tetrahydrofuran to obtain a solution, to which titanium phthalocyanine was subsequently mixed. The mixture was subjected to ultrasonic dispersion treatment for 1 hour to obtain a dispersion. The dispersion was applied with a wire bar to the surface of an aluminum layer evaporation-deposited on a polyester substrate having a thickness of 75 μm. The coat was then dried to form a charge generating layer having a thickness of 0.3 μm.

| Coating Liquid for Charge-Transporting Layer: | |
|---|---|
| 2-Methyl-4-dibenzylaminobenzaldehyde-1,1-diphenylhydrazone*[2] | 3 parts |
| Polycarbonate*[3] | 3 parts |
| Methylene chloride/cyclohexanone 4:1 wt/wt mixed solvent | 25 parts |

*[2]Compound of the formula (I) in which $R^1$ is 2-methyl and $R^2$, $R^3$ and $R^4$ are each hydrogen

*[3]Panlite L-1250 (manufactured by Teijin K.K.)

The above ingredients were mixed with a stirrer to obtain a solution. The solution was then applied with a spinner to the surface of the above charge generating layer and dried to form a charge transporting layer having a thickness of 17 μm.

The thus obtained photosensitive material was subjected to corona discharge at −6KV in a static method by using a electrostatic charging tester (EPA-8100, manufactured by Kawaguchi Denki K.K. As a result, the photosensitive material had a surface potential $V_0$ as shown in Table 1. The photosensitive material was then allowed to stand in the dark for 5 seconds and the surface potential $V_5$ was measured. The dark decay was calculated by $(1-V_5)\times 100/V_0$ and the result was as shown in Table 1. Subsequently, the photosensitive material was subjected to light exposure at an intensity of surface illumination of 10 luxes while measuring the surface potential. The photosensitivity of the photosensitive material was evaluated in terms of $E_{1/2}$ from a period of time through which the surface potential is decreased to half ($V_5/2$), and $E_{1/5}$ from a period of time through which the surface potential is decreased to 1/5 ($V_5/5$). The results are shown in Table 1. The photosensitive material was further tested for its spectral sensitivity in terms of light energy required for reducing by half the surface potential when it was subjected to light exposure of a 1 $\mu W/cm^2$ light from a monochrometer. The results are shown in Table 2.

EXAMPLE 2

| Coating Liquid for Charge Generating Layer: | |
|---|---|
| Saturated polyester resin*1 | 5 parts |
| Titanium phthalocyanine | 5 parts |
| 1-Chloronaphthalene | 10 parts |
| Cyclohexanone/dioxane 1:9 (wt/wt) mixed solvent | 350 parts |

*1Bilon 200 (manufactured by Toyo Boseki K.K.)

The above polyester resin was dissolved in cyclohexanone/dioxane to obtain a solution, to which the phthalocyanine was subsequently mixed. The mixture was subjected to a treatment with an ultrasonic homogenizer for 1 hour to obtain a dispersion. The dispersion was applied with a wire bar to the surface of an aluminum layer evaporation-deposited on a polyester substrate having a thickness of 75 $\mu$m. The coat was then dried at 80° C. with hot air to form a charge generating layer having a thickness of 0.3 $\mu$m and containing 50% by weight of the chloronaphthalene based on the total solids in the charge generating layer.

| Coating Liquid for Charge-Transporting Layer: | |
|---|---|
| 2-Methyl-4-dibenzylaminobenzaldehyde-1,1-diphenylhydrazone*2 | 3 parts |
| Polycarbonate*3 | 3 parts |
| Cyclohexanone/dioxane 1/4 (wt/wt) mixed solvent | 25 parts |

*2Compound of the formula (I)
*3Panlite L-1250 (manufactured by Teijin K.K.)

The above ingredients were mixed with a stirrer to obtain a solution. The solution was then applied with a spinner to the surface of the above charge generating layer and dried at 80° C. with hot air to form a charge transporting layer having a thickness of 18 $\mu$m.

The resulting photosensitive material was tested for its dark decay and sensitivity in the same manner as described in Example 1. The results are summarized in Table 1. Further, the corona discharge and light exposure operation was repeated 10000 times in total and the dark decay and sensitivity were measured after the 10000 times operations. Reduction in charging efficiency upon repeated use was found be small.

EXAMPLE 3

| Coating Liquid for Charge Generating Layer: | |
|---|---|
| Saturated polyester resin*1 | 5 parts |
| Titanium phthalocyanine | 5 parts |
| Dioxane/cyclohexanone 9:1 (wt/wt) mixed solvent | 350 parts |
| **Coating Liquid for Charge-Transporting Layer:** | |
| 2-Methyl-4-dibenzylaminobenzaldehyde-1,1-diphenylhydrazone*2 | 3 parts |
| Polycarbonate*3 | 3 parts |
| Dioxane/tetrahydrofuran 5:2 (wt/wt) mixed solvent | 25 parts |

*1Bilon 200 (manufactured by Toyo Boseki K.K.)
*2Compound of the formula (I)
*3Panlite L-1250 (manufactured by Teijin K.K.)

Using the above coating liquids photosensitive material was prepared in the same manner as described in Example 5. The dark decay and sensitivity were measured in the same manner as described in Example 1. The results are shown in Table 1. Further, the coating liquid for the formation of the 10 charge-transporting layer was tested for its stability. Thus, the solution was allowed to stand at 23° C., 40% humidity and was observed for the formation of gel or aggregate 5, 10 and 20 days after the preparation of the solution. Neither a gel nor an aggregate was detected. On the other hand, when the 15 dioxane/tetrahydrofuran mixed solvent for the formation of the charge transporting layer was replaced by a cyclohexanone/ dichloromethane (1:4) mixed solvent or tetrahydrofuran, gellation or aggregation was observed 5 or 10 days after the preparation of the coating solution. results are shown in Table 1.

COMPARATIVE EXAMPLE 1

Example 1 was repeated in the same manner as described except that $\epsilon$-form cupriophthlocyanine (EP-7, manufactured by Dainihon Ink Kagaku Kogyo K.K.) was used in place of titanium phthalocyanine. The properties of the resulting photosensitive material are shown in Tables 1 and 2.

COMPARATIVE EXAMPLE 2

Example 1 was repeated in the same manner as described except that p-diethylaminobenzaldehyde-1,1-diphenylhydrazone was used in place of the hydrazone of the formula (I). The properties of the resulting photosensitive material 15 are shown in Tables 1 and 2.

TABLE 1

| | $V_0$ (V) | $V_5$ (V) | Dark decay (%) | $E_{\frac{1}{2}}$ (lux sec) | $E_{1/5}$ (lux sec) | Residual potential (V) |
|---|---|---|---|---|---|---|
| Example | | | | | | |
| 1 | −942 | −820 | 13 | 1.2 | 2.0 | 0 |
| 2 | −953 | −781 | 18 | 0.77 | 1.3 | 0 |
| 3 | −810 | −631 | 22 | 1.0 | 1.6 | −2 |
| Comparative Example | | | | | | |
| 1 | −866 | −652 | 24 | 4.2 | 9.6 | −25 |
| 2 | −804 | −626 | 22 | 1.2 | 2.2 | −4 |

TABLE 2

| | Spectral Sensitivity ($\mu J/cm^2$) | | |
|---|---|---|---|
| | 700 nm | Maximum wavelength | 800 nm |
| Example 1 | 0.53 | 0.35 (850 nm) | 0.50 |
| Example 2 | 0.53 | 0.34 (850 nm) | 0.51 |
| Example 3 | 0.52 | 0.35 (850 nm) | 0.48 |
| Comparative Example 1 | 2.10 | 1.66 (770 nm) | 2.30 |
| Comparative Example 2 | 0.55 | 0.36 (850 nm) | 0.55 |

What is claimed is:

1. An electrophotographic photosensitive material comprising a charge generating layer and a charge transporting layer formed on an electrically conducting support, said charge generating layer containing a titanium phthalocyanine pigment and 25-200% of a substituted naphthalene, based on the weight of the remainder of said charge generating layer, and said charge transporting layer containing a hydrazone compound expressed by the following general formula (I):

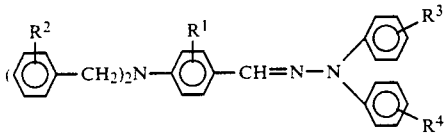

(I)

wherein $R^1$, $R^2$, $R^3$ and $R^4$ stand, independently from each other, hydrogen or lower alkyl.

2. A photosensitive material as claimed in claim 1, wherein said substituted naphthalene has one or more substituents selected from the group consisting of halogen atoms, lower alkyl groups and lower alkoxy groups.

3. A method of preparing a photosensitive material according to claim 1, comprising the steps of:

(a) providing a solution containing polycarbonate resin, said compound of the formula (I) and a dioxane-containing solvent, said solution containing said solvent in an amount of 3-10 times the weight of said polycarbonate resin;

(b) providing a dispersion containing said titanium phthalocyanine pigment, a substituted naphthalene in the amount of 25-200% of the remainder of the charge generating layer, a binder resin and a mixed solvent containing dioxande and 3-100 parts by weight of cyclohexanone per 100 parts by weight of said dioxane, coating said dispersion over said support, and drying the resulting coat to form said charge generating layer on said support;

(c) applying said solution over said charge generating layer to form a coated layer; and (d) drying said coated layer to form said charge transporting layer on said charge generating layer.

4. A method as claimed in claim 3, wherein said solvent is used in an amount of 3-10 times the weight of said polycarbonate resin.

5. The electrophotographic photosensitive material of claim 1 wherein said substituted naphthalene constitutes 40-200% of the remainder of said charge generating layer.

6. The method of claim 3 wherein said dispersion contains said substituted naphthalene in an amount of 40-200% of the remainder of the charge generating layer.

7. An electrographic photosensitive material in accordance with claim 1 wherein said charge generating layer contains said substituted naphalene in the amount of 25-70% based on the weight of the remainder of said charge generating layer.

8. An electrographic photosensitive material in accordance with claim 1 wherein said charge generating layer contains said substituted naphthalene in the amount of 40-70%, based on the weight of the remainder of said charge generating layer.

* * * * *